US005626105A

United States Patent [19]

Locke et al.

[11] Patent Number: 5,626,105

[45] Date of Patent: May 6, 1997

[54] VERTICAL SHAFT GENERATOR WITH SINGLE COOLING FAN

[75] Inventors: Richard D. Locke, Sheboygan; Terrence M. Rotter, Sheboygan Falls, both of Wis.

[73] Assignee: Kohler Co., Kohler, Wis.

[21] Appl. No.: 547,261

[22] Filed: Oct. 24, 1995

[51] Int. Cl.[6] ..... F02B 77/00

[52] U.S. Cl. ..... 123/3; 123/41.65; 123/41.55

[58] Field of Search ..... 123/2, 3, 41.55, 123/41.56, 41.65, 41.7

[56] References Cited

U.S. PATENT DOCUMENTS

| | | | |
|---|---|---|---|
| 1,892,997 | 1/1933 | Oldenburg | 310/50 |
| 2,156,957 | 5/1939 | Aydelott | 290/1 R |
| 2,469,820 | 5/1949 | Fuge | 172/36 |
| 2,543,541 | 2/1951 | Angle | 290/1 |
| 2,735,030 | 2/1956 | Brainard | 310/261 |
| 3,064,152 | 11/1962 | De Paul et al. | 310/254 |
| 3,206,627 | 9/1965 | Marek | 310/59 |
| 3,259,752 | 7/1966 | Honda et al. | 290/1 R |
| 3,643,119 | 2/1972 | Lukens | 310/60 |
| 4,173,951 | 11/1979 | Ishihara | 123/2 |
| 4,540,888 | 9/1985 | Drewry et al. | 290/1 R |
| 4,553,055 | 11/1985 | Auernhammer | 310/62 |
| 4,622,923 | 11/1986 | Hishimura et al. | 123/2 |
| 4,647,835 | 3/1987 | Fujikawa et al. | 322/1 |
| 4,677,940 | 7/1987 | Bracht et al. | 123/2 |
| 4,779,905 | 10/1988 | Ito et al. | 290/1 B |
| 4,856,470 | 8/1989 | Ishii et al. | 123/195 C |
| 4,907,546 | 3/1990 | Ishii et al. | 123/41.7 |
| 5,121,715 | 6/1992 | Nogami et al. | 123/2 |

*Primary Examiner*—David A. Okonsky
*Attorney, Agent, or Firm*—Quarles & Brady

[57] ABSTRACT

An engine driven generator set includes a vertical shaft engine which rotates a generator rotor and a centrifugal fan mounted above the engine. A plenum collects cooling air blown over generator stator windings by the fan and directs the cooling air through an air duct over the engine cylinder head. Electronic circuitry is cooled by this same cooling air.

8 Claims, 3 Drawing Sheets

FIG. 3
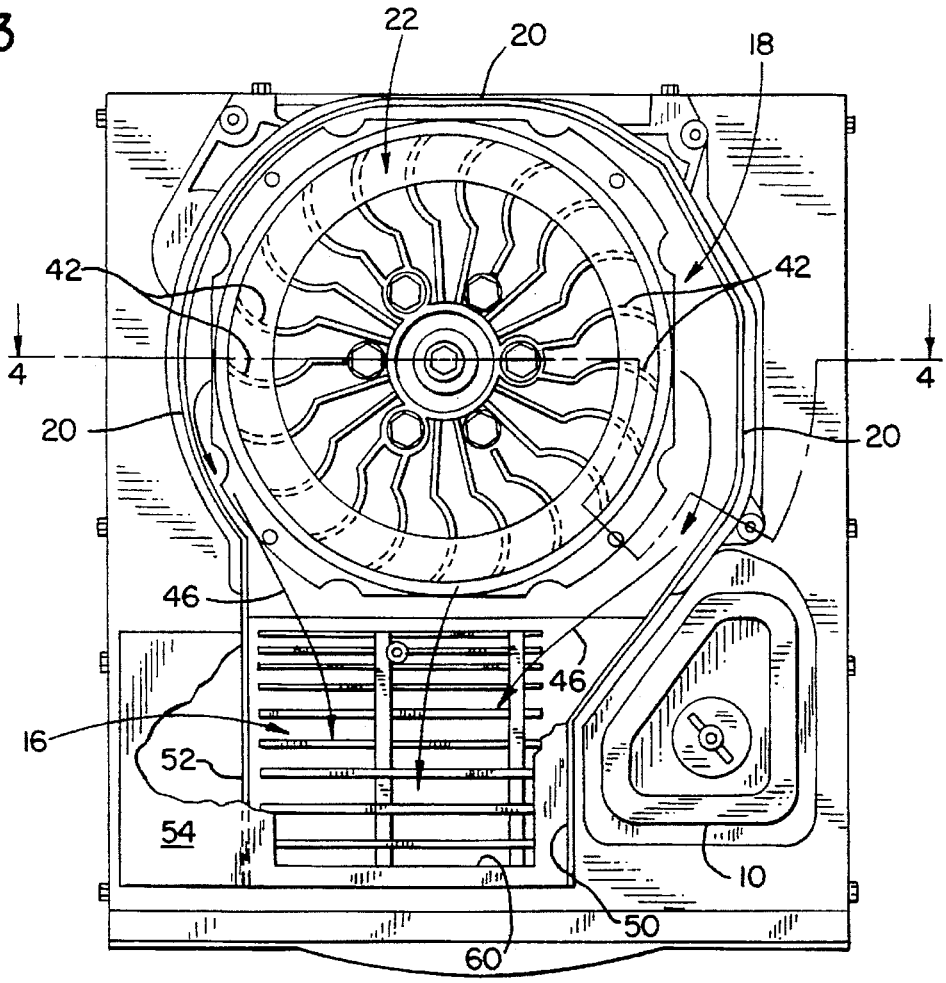
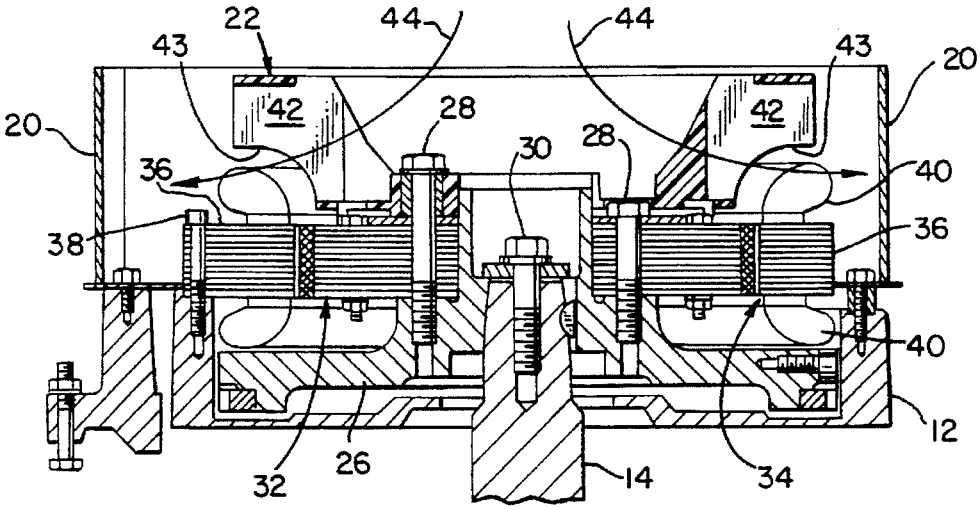
FIG. 4

VERTICAL SHAFT GENERATOR WITH SINGLE COOLING FAN

BACKGROUND OF THE INVENTION

The field of the invention is engine generator sets, and particularly, small compact generator units for portable use or for use in recreational vehicles.

Small, vertical shaft engine generator sets such as those disclosed in U.S. Pat. Nos. 4,450,888 and 4,677,940 include a small gasoline or gas powered engine which rotates the rotor of an electric generator. Heat is produced by both the engine and generator and this heat must be removed for proper system operation. Portable generators are housed in a compact, aesthetically pleasing enclosure, and generators for recreational vehicles are housed in compact compartments formed in the vehicle. In both applications the proper removal of heat is a significant design challenge.

The conventional solution for removal of heat is to provide separate cooling fans for the engine and the generator. As disclosed in the above-cited patents, for example, a fan is disposed on top of the engine and is driven by the vertical engine shaft to blow cooling air over the air-cooled engine. The generator is mounted below the engine, and the generator rotor and a generator cooling fan are both driven by the vertical engine shaft. The generator cooling fan cools the generator stator windings and it may also provide some engine cooling as well. The use of two fans in systems such as these is expensive, and the use of two fans increases the vertical height of the generator set.

A vertical shaft, engine generator set which employs a single cooling fan is disclosed in U.S. Pat. Nos. 4,779,905 and 4,856,470. In these systems cooling air is drawn in over the engine and then around the generator stator windings before being exhausted. Because the engine is cooled first, proper cooling of the more sensitive generator windings is problematic, particularly when a more compact generator construction is used. Also, there is no provision for cooling electronic circuitry which is used on state-of-the-art generator sets to regulate generator output voltage.

SUMMARY OF THE INVENTION

The present invention is a compact, vertical shaft engine generator set in which the generator is disposed above the engine and a single fan is disposed above the generator to blow cooling air over the generator stator windings, the electronic generator control circuitry and the engine. More particularly, the engine generator set includes an air-cooled engine which rotates a vertically disposed shaft that extends upward from the engine and which has a heat producing cylinder head that extends laterally outward to one side of the engine; a generator mounted above the engine and having a rotor coupled for rotation by the shaft and a stator with its windings disposed around the rotor; a fan mounted above the generator and coupled for rotation by the shaft to blow cooling air downward and over the stator windings; a plenum formed around the fan to direct the air over the stator windings; and an air duct coupled to the plenum to direct cooling air downward from the plenum to cool the engine cylinder head. Electronic circuitry used to control generator output voltage is mounted adjacent to the air duct and electronic components therein are cooled by cooling air flowing in the air duct.

A general object of the invention is to cool the engine and generator with a single fan. By mounting the generator above the engine, its windings and associated electronic circuitry can be cooled first by cool air drawn in from the top and directed downward through the air duct to the engine cylinder head. The heated air is exhausted through an opening in the bottom panel of a surrounding enclosure.

A more specific object of the invention is to cool generator electronic components with the same fan used to cool both generator and engine. The heat producing electronic components are mounted to the plenum wall or air duct which serve as a heat sink, or a heat sink is mounted in the air flow through the air duct.

Another object of the invention is to reduce the height of a vertical shaft engine generator set. By making efficient use of the large radial area above the engine, the stack height of the generator rotor and surrounding stator windings is kept to a minimum.

A more specific object of the invention is to reduce the axial height of the fan. By contouring the shape of the fan blades to the profile of the stator windings, the fan is compactly mounted above the generator with minimal increase in height.

Yet another object of the invention is to reduce the temperature of combustion air supplied to the enclosed engine. The plenum is coupled to a housing formed around the air filter at the air intake of the engine, and combustion air is supplied from the plenum.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 3 is a top view of the engine generator set of FIG. 2 with parts cut away;

FIG. 4 is a view in cross section taken through the plane 4—4 indicated in FIG. 3;

DESCRIPTION OF THE PREFERRED EMBODIMENT

Figure 1:
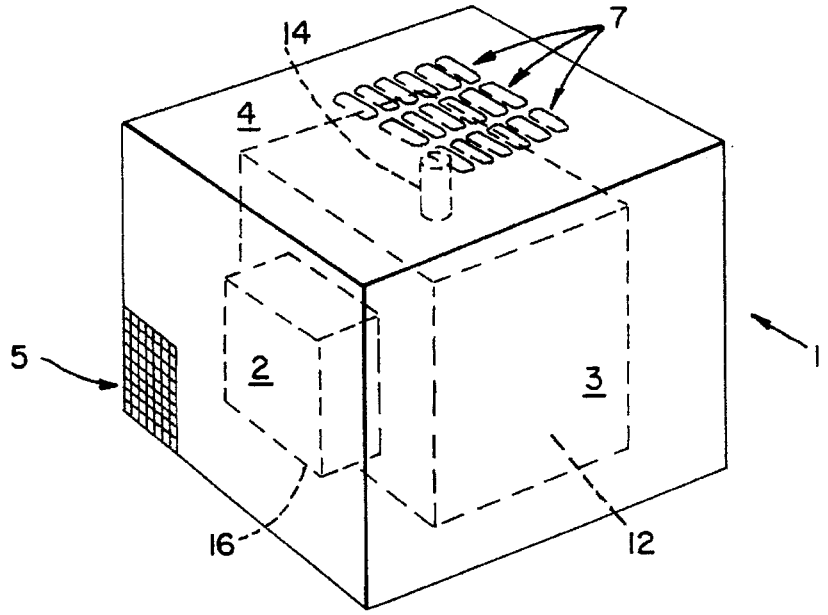
FIG. 1 is a perspective view of the preferred embodiment of the engine generator set which employs the present invention.

Referring particularly to FIG. 1, the engine generator set is enclosed in a housing 1 having a front panel 2, side panels 3 and a top panel 4. A control panel 5 is disposed on the front panel 2 and both cooling air and combustion air are drawn in through louvers 7 formed in the top panel 4. Both combustion air and cooling air are exhausted through openings in the bottom (not shown in the drawings) of the housing 1.

Figure 2:
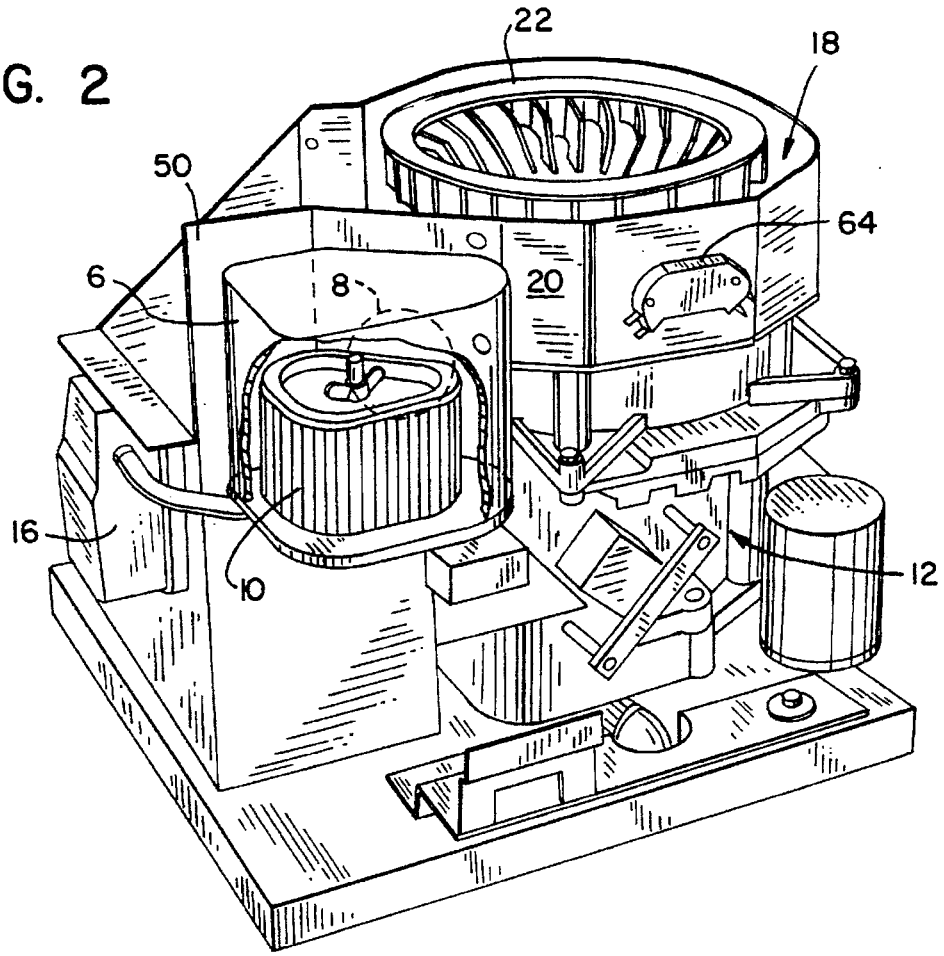
FIG. 2 is a perspective view of the engine generator set of FIG. 1 with the enclosure removed.

Referring to FIGS. 1 and 2, the engine combustion air is passed through an air filter 10 into an internal combustion engine 12 which is oriented inside the housing 1 with its crank shaft 14 vertical and its cylinder head 16 extending horizontally towards the front panel 2. A substantially cylindrical plenum 18 is formed beneath the top panel 4 by an upright sheet metal wall 20 mounted to the top of the engine 12. The plenum 18 surrounds a centrifugal fan 22 which is rotated by the engine shaft 14 to draw air in through the louvers 7 and direct it downward and radially outward against the surrounding plenum wall 20. The air filter 10 is enclosed by a cover 6, and combustion air is received through an opening 8 in the plenum wall 20.

Referring particularly to FIGS. 3 and 4, the centrifugal fan 22 is fastened to a flywheel 26 by bolts 28. The flywheel 26 is in turn fastened to the end of the engine crank shaft 14 by bolt 30. Sandwiched between the fan 22 and the flywheel 26, and held in place by bolts 28, is the rotor 32 of the generator. The rotor 32 is comprised of stacked steel laminations constructed as described in co-pending U.S. patent application Ser. No. 335,408 filed on Dec. 9, 1994 and entitled "Rotor With Embedded Rare-Earth Permanent Magnets". The rotor 32 extends radially outward from the shaft 14 and defines the inner surface of a circular, cylindrical generator air gap 34. The outer boundary of the air gap 34 is defined by the stacked steel laminations of a generator stator 36 which is fastened to the top of generator adapter 12 by bolts 38. The stator windings 40 are supported by these laminations and they extend upward and downward therefrom. Blades 42 on the centrifugal fan 22 are cut away along their lower edge 43 to provide clearance for the upward extending stator windings 40 while maintaining the height of these elements to a minimum.

Referring particularly to FIG. 4, when the shaft 14 is rotated by the engine, the flywheel 26, the rotor 32 and the centrifugal fan 22 are rotated about its vertical axis. The fan 22 draws cooling air downward and blows it radially outward over the stator windings 40 as indicated by arrows 44. As shown by arrows 46 in FIG. 3, this cooling air is corralled by the plenum wall 20 and directed forward and downward towards the engine cylinder head 16, as will now be described in more detail.

Figure 5:
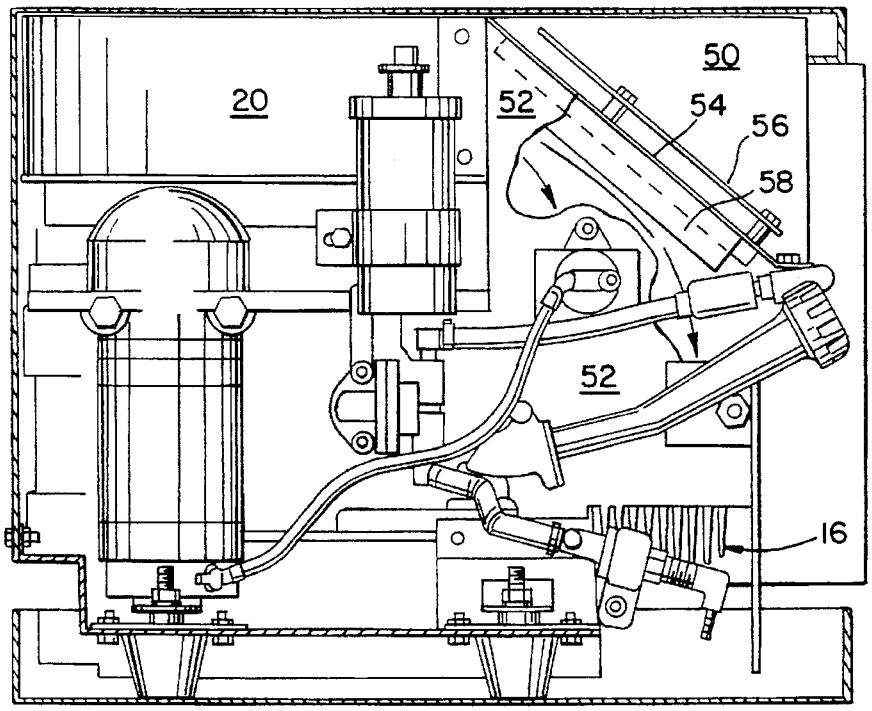
FIG. 5 is a side elevation view of the engine generator set of FIG. 1 with parts cut away.
Figure 6:
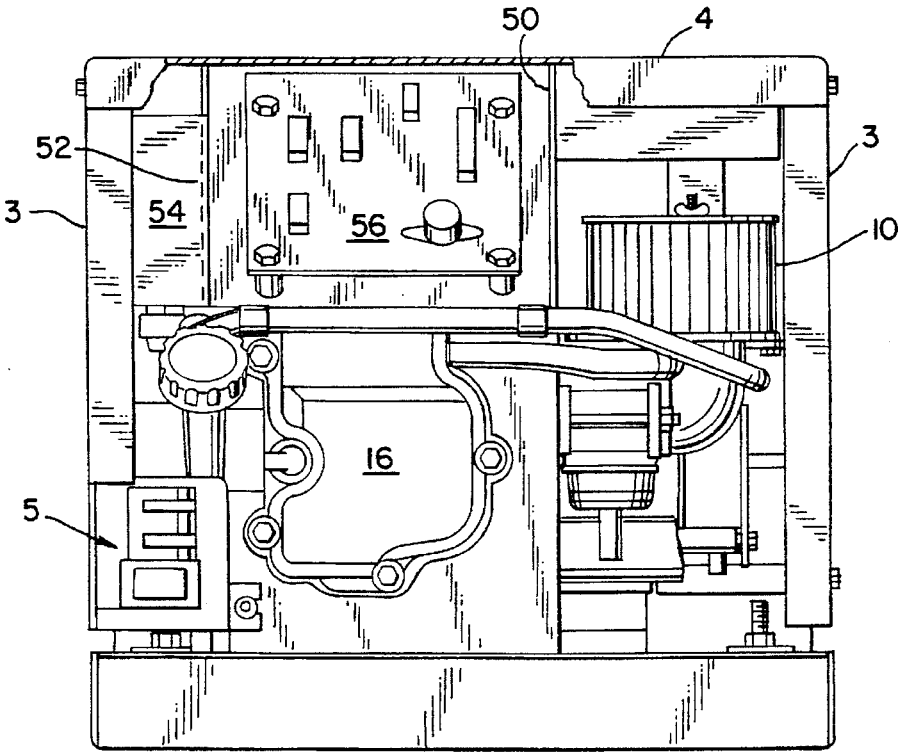
FIG. 6 is a front elevation view of the engine generator set of FIG. 1 with parts cut away.

Referring particularly to FIGS. 3, 5 and 6, the walls 20 of the plenum 18 are extended forward and downward to form an air duct which directs cooling air from the plenum 18 to the engine cylinder head 16. More specifically, the air duct is formed by a vertical sheet metal wall 5a which extends forward from the plenum wall 20 to the front panel 2 adjacent the air cleaner 10, and extends downward along one side of the cylinder head 16. A second vertical sheet metal wall 52 spaced away from the wall 50 extends forward from the plenum wall 20 to the front panel 2 and extends downward to the other side of the cylinder head 16. The top edge of this wall 52 angles downward from the plenum wall 20 and supports an electronics support wall 54 that slopes downward and forms the top of the air duct. The air duct formed by walls 50, 52 and 54 deflects cooling air downward and around the cylinder head 16.

An electronics circuit board 56 mounts to the support wall 54 and it includes heat sinks 58 that extend downward into the cooling air stream through an opening 60 formed in the support wall 54. Cooling air is forced from the plenum 18, through the air duct and around the cylinder head 16. The electronics circuit 56 is mounted to this air duct and is cooled by the air flowing therethrough. Also, as shown best in FIG. 2, electronic components such as diodes or SCRs 64 that produce large amounts of heat can be mounted directly to the walls of the plenum 18 or air duct. In this case, the cooled metal wall serves as a heat sink for the electronic component.

We claim:

1. An engine driven generator set which comprises:

an air-cooled engine which rotates a vertically disposed shaft that extends upward from the engine and which has a cylinder head that extends laterally outward to one side of the engine;

a generator mounted above the engine and having a rotor coupled for rotation by the shaft and a stator disposed around the rotor and supporting stator windings;

a fan mounted above the generator and coupled for rotation by the shaft to blow cooling air over the stator windings;

a plenum formed around the fan to confine the air blown over the stator windings; and an air duct coupled to the plenum to direct cooling air from the plenum to cool the engine cylinder head;

wherein the fan is a centrifugal fan which draws cooling air in from above and blows it radially outward over the stator winding and into the surrounding plenum.

2. The generator set as recited in claim 1 in which the engine, generator and fan are enclosed by a housing having a top panel which forms part of the plenum, and openings are formed in the top panel above the fan to enable said cooing air to enter.

3. The generator set as recited in claim 1 in which an electronic component is mounted for cooling by air flowing through said plenum and air duct.

4. The generator set as recited in claim 3 in which the electronic components are mounted to a wall of the air duct.

5. The generator set as recited in claim 3 in which the electronic components are mounted to a circuit board which forms a wall of the air duct.

6. The generator set as recited in claim 3 in which a heat sink fastens to the circuit board and extends into the air duct.

7. The generator set as recited in claim 1 in which the centrifugal fan has blades which are shaped to follow the contour of the stator windings located adjacent thereto.

8. The generator set as recited in claim 1 which includes means for coupling the plenum to an air intake on the air-cooled engine and combustion air for the air-cooled engine is supplied from the plenum.

* * * * *